US007299182B2

(12) United States Patent
Xie

(10) Patent No.: US 7,299,182 B2
(45) Date of Patent: Nov. 20, 2007

(54) TEXT-TO-SPEECH (TTS) FOR HAND-HELD DEVICES

(75) Inventor: Jianlei Xie, Carmel, IN (US)

(73) Assignee: Thomson Licensing, Boulogne (FR)

( * ) Notice: Subject to any disclaimer, the term of this patent is extended or adjusted under 35 U.S.C. 154(b) by 636 days.

(21) Appl. No.: 10/142,406

(22) Filed: May 9, 2002

(65) Prior Publication Data

US 2003/0212559 A1 Nov. 13, 2003

(51) Int. Cl.
*G10L 13/00* (2006.01)
*G10L 13/02* (2006.01)

(52) U.S. Cl. ..... 704/258; 704/260; 704/267

(58) Field of Classification Search ..... 704/258, 704/260, 261, 267, 268, 269, 270, 271, 274; 368/244, 245; 340/575
See application file for complete search history.

(56) References Cited

U.S. PATENT DOCUMENTS

| | | | | |
|---|---|---|---|---|
| 4,377,345 | A * | 3/1983 | Yamada et al. | 368/245 |
| 4,389,121 | A * | 6/1983 | Hashimoto et al. | 368/63 |
| 4,701,862 | A * | 10/1987 | Washizuka et al. | 704/274 |
| 4,985,697 | A | 1/1991 | Boulton | |
| 5,386,493 | A * | 1/1995 | Degen et al. | 704/267 |
| 5,611,018 | A * | 3/1997 | Tanaka et al. | 704/215 |
| 5,615,380 | A * | 3/1997 | Hyatt | 345/520 |
| 5,694,521 | A * | 12/1997 | Shlomot et al. | 704/262 |
| 5,771,273 | A * | 6/1998 | McAllister et al. | 379/88.01 |
| 5,812,977 | A * | 9/1998 | Douglas | 704/275 |
| 5,826,231 | A * | 10/1998 | Vigier | 704/262 |
| 5,850,629 | A | 12/1998 | Holm et al. | 704/260 |
| 6,009,398 | A * | 12/1999 | Mueller et al. | 704/275 |
| 6,182,041 | B1 * | 1/2001 | Li et al. | 704/260 |
| 6,236,622 | B1 * | 5/2001 | Blackman | 368/10 |
| 6,310,833 | B1 * | 10/2001 | Guyett et al. | 368/63 |
| 6,324,511 | B1 | 11/2001 | Kiraly et al. | 704/260 |
| 6,557,173 | B1 * | 4/2003 | Hendricks | 725/142 |
| 6,633,741 | B1 * | 10/2003 | Posa et al. | 434/317 |
| 6,748,358 | B1 * | 6/2004 | Iwasaki et al. | 704/258 |
| 6,838,994 | B2 * | 1/2005 | Gutta et al. | 340/575 |
| 6,876,969 | B2 * | 4/2005 | Nakao | 704/260 |
| 6,925,437 | B2 * | 8/2005 | Hayashi | 704/260 |
| 7,240,005 | B2 * | 7/2007 | Chihara | 704/267 |
| 2001/0027395 | A1 * | 10/2001 | Sakai et al. | 704/258 |
| 2002/0107591 | A1 * | 8/2002 | Gabai et al. | 700/94 |
| 2002/0184189 | A1 * | 12/2002 | Hay et al. | 707/1 |
| 2003/0004723 | A1 * | 1/2003 | Chihara | 704/260 |
| 2003/0009337 | A1 * | 1/2003 | Rupsis | 704/260 |
| 2003/0014252 | A1 * | 1/2003 | Shizuka et al. | 704/258 |

FOREIGN PATENT DOCUMENTS

| | | |
|---|---|---|
| EP | 0 339 316 A | 11/1989 |
| WO | WO 01/01373 A | 1/2001 |

OTHER PUBLICATIONS

International Search Report for International Application No. PCT/US03/14301, Jul. 14, 2003.

* cited by examiner

*Primary Examiner*—Martin Lerner
(74) *Attorney, Agent, or Firm*—Joseph J. Laks; Ronald H. Kurdyla; Brian J. Dorini

(57) ABSTRACT

There is provided an Ebook. The Ebook includes a memory device, a text-to-speech (TTS) module, and at least one speaker. The memory device stores files. The files include text. The TTS module synthesizes speech corresponding to the text. The at least one speaker outputs the speech.

23 Claims, 5 Drawing Sheets

TEXT-TO-SPEECH (TTS) FOR HAND-HELD DEVICES

CROSS-REFERENCE TO RELATED APPLICATIONS

This application is related to U.S. patent application Ser. No. 10/154,147, entitled "Talking Ebook", filed on May 22, 2002, U.S. patent application Ser. No. 10/146,406, entitled "Voice Command and Voice Recognition for Hand-Held Devices", filed on May 15, 2002, and U.S. patent application Ser. No. 10/135,151, entitled "Mixing Music and Text-To-Speech (TTS) for Hand-Held Devices", filed on Apr. 23, 2002, which are commonly assigned and concurrently filed herewith, and the disclosures of which are incorporated herein by reference.

BACKGROUND OF THE INVENTION

1. Field of the Invention

The present invention generally relates to hand-held devices and, more particularly, to text-to-speech (TTS) for hand-held devices.

2. Background of the Invention

An electronic book (also referred to as an "Ebook") is an electronic version of a traditional print book (or other printed material such as, for example, a magazine, newspaper, and so forth) that can be read by using a personal computer or by using an Ebook reader. Unlike PCs or handheld computers, Ebook readers deliver a reading experience comparable to traditional paper books, while adding powerful electronic features for note taking, fast navigation, and key word searches. However, such actions, irrespective of whether or not they are performed on a PC, handheld computer, or Ebook reader, generally require the user to read the text from a display. Thus, the use of an Ebook generally requires the user to focus his or her visual attention on a display to read the text content (e.g., book, magazine, newspaper, and so forth) of the Ebook. Moreover, the use of any hand-held device requires the user to focus his or her visual attention on a display for one purpose or another.

Accordingly, it would be desirable and highly advantageous to have a hand-held device such as, for example, an Ebook, that allows a user to assimilate content without having to look at a display.

SUMMARY OF THE INVENTION

The problems stated above, as well as other related problems of the prior art, are solved by the present invention, a hand-held device having text-to-speech (TTS) capabilities.

According to an aspect of the present invention, there is provided an Ebook. The Ebook comprises a memory device, a text-to-speech (TTS) module, and at least one speaker. The memory device stores files. The files include text. The TTS module synthesizes speech corresponding to the text. The at least one speaker outputs the speech.

According to another aspect of the present invention, there is provided a method for using an Ebook. At least one file is stored in the Ebook. The at least one file includes text. Speech corresponding to the text is synthesized and output from the Ebook.

These and other aspects, features and advantages of the present invention will become apparent from the following detailed description of preferred embodiments, which is to be read in connection with the accompanying drawings.

DETAILED DESCRIPTION OF THE INVENTION

The present invention is directed to a hand-held device having text-to-speech (TTS) capabilities and to a method for using a hand-held device having text-to-speech (TTS) capabilities. It is to be appreciated that the present invention is directed to any type of hand-held device including, but not limited to, electronic books (Ebooks), personal digital assistants (PDAs), and so forth. However, for the purposes of describing the present invention, the following description will be provided with respect to Ebooks.

It is to be understood that the present invention may be implemented in various forms of hardware, software, firmware, special purpose processors, or a combination thereof. Preferably, the present invention is implemented as a combination of hardware and software. Moreover, the software is preferably implemented as an application program tangibly embodied on a program storage device. The application program may be uploaded to, and executed by, a machine comprising any suitable architecture. Preferably, the machine is implemented on a computer platform having hardware such as one or more central processing units (CPU), a random access memory (RAM), and input/output (I/O) interface(s). The computer platform also includes an operating system and microinstruction code. The various processes and functions described herein may either be part of the microinstruction code or part of the application program (or a combination thereof) which is executed via the operating system. In addition, various other peripheral devices may be connected to the computer platform such as an additional data storage device and a printing device.

It is to be further understood that, because some of the constituent system components and method steps depicted in the accompanying Figures are preferably implemented in software, the actual connections between the system components (or the process steps) may differ depending upon the manner in which the present invention is programmed. Given the teachings herein, one of ordinary skill in the related art will be able to contemplate these and similar implementations or configurations of the present invention.

Figure 1:
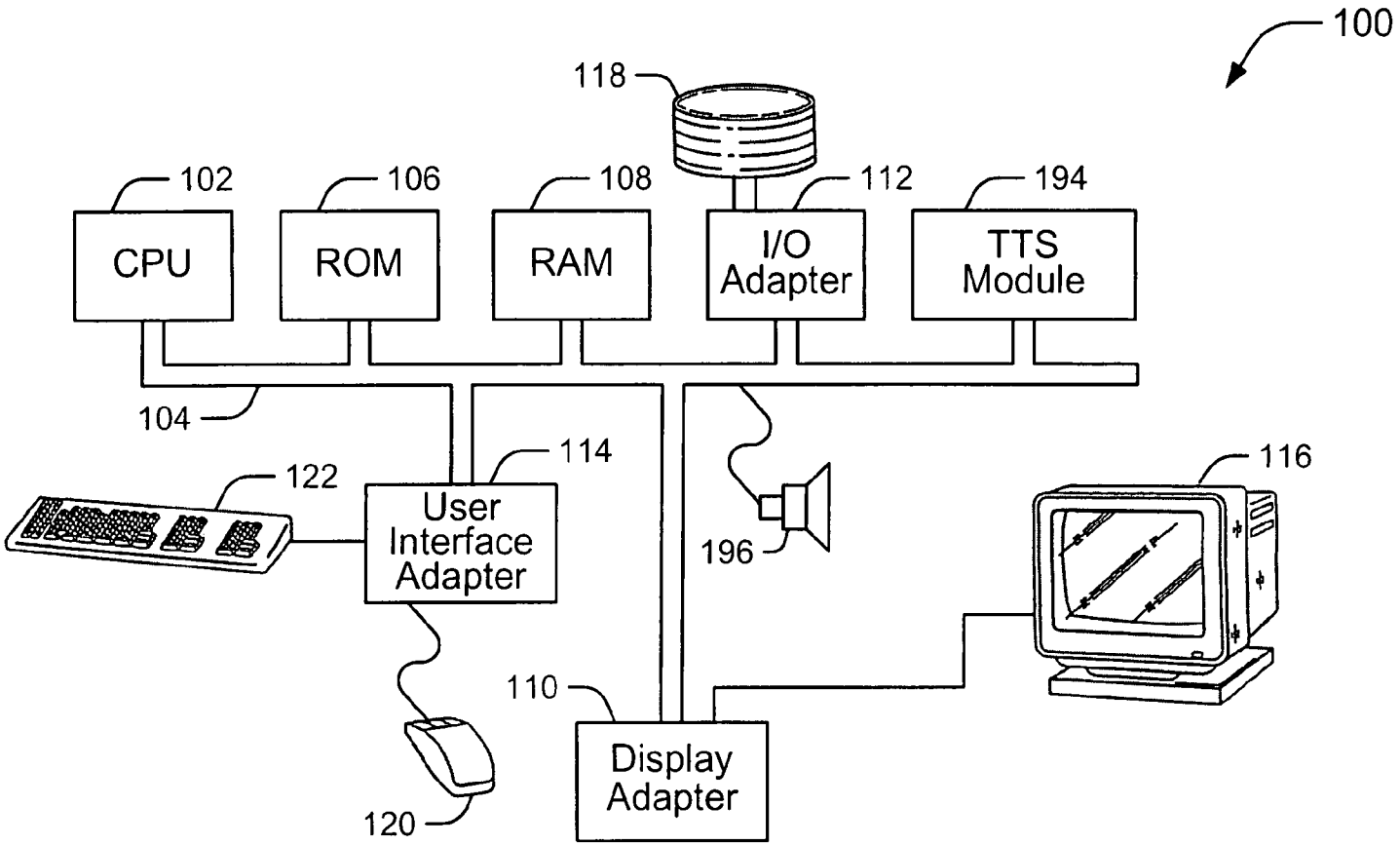
FIG. 1 is a block diagram illustrating a computer system 100 to which the present invention may be applied, according to an illustrative embodiment of the present invention.

FIG. 1 is a block diagram illustrating a computer system 100 to which the present invention may be applied, according to an illustrative embodiment of the present invention. The computer processing system 100 includes at least one processor (CPU) 102 operatively coupled to other components via a system bus 104. A read only memory (ROM) 106, a random access memory (RAM) 108, a display adapter 110, an I/O adapter 112, and a user interface adapter 114 are operatively coupled to the system bus 104.

A display device 116 is operatively coupled to system bus 104 by display adapter 110. A disk storage device (e.g., a magnetic or optical disk storage device) 118 is operatively coupled to system bus 104 by I/O adapter 112.

A mouse 120 and keyboard 122 are operatively coupled to system bus 104 by user interface adapter 114. The mouse 120 and keyboard 122 are used to input and output information to and from system 100.

The computer system 100 further includes a text-to-speech (TTS) module 194 and a speaker 196.

Figure 2:
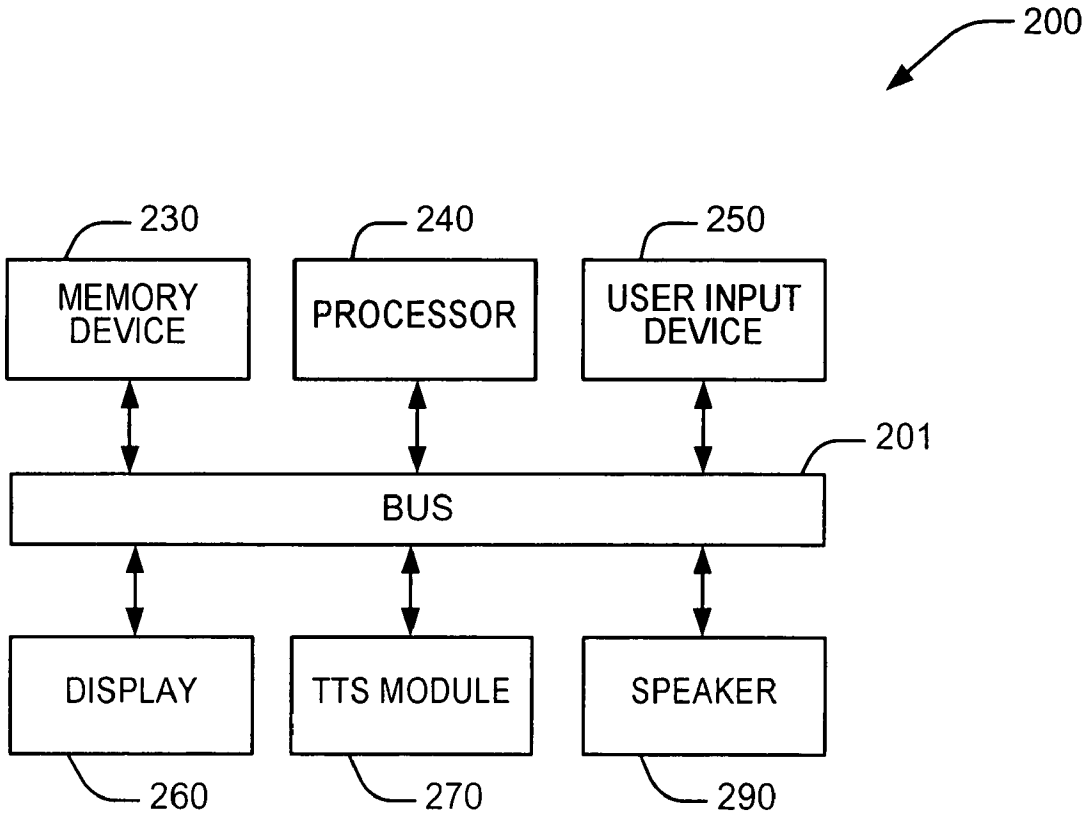
FIG. 2 is a block diagram illustrating an Ebook 200, according to an illustrative embodiment of the present invention.

FIG. 2 is a block diagram illustrating an Ebook 200, according to an illustrative embodiment of the present invention. The Ebook 200 includes the following elements interconnected by bus 201: at least one memory device (hereinafter "memory device" 230); at least one processor (hereinafter "processor" 240); a user input device 250 (e.g., keyboard, keypad, and/or remote control); a display 260; a text-to-speech (TTS) module 270; and a speaker 290. Given the teachings of the present invention provided herein, one of ordinary skill in the related art will contemplate these and various other configurations of the computer system 100 and Ebook 200 respectively shown in FIGS. 1 and 2, while maintaining the spirit and scope of the present invention. It is to be appreciated that as used herein the term "Ebook" refers to either a standalone Ebook device (e.g., Ebook 200) or an Ebook included in a computer system (e.g., computer system 100).

Figure 3:
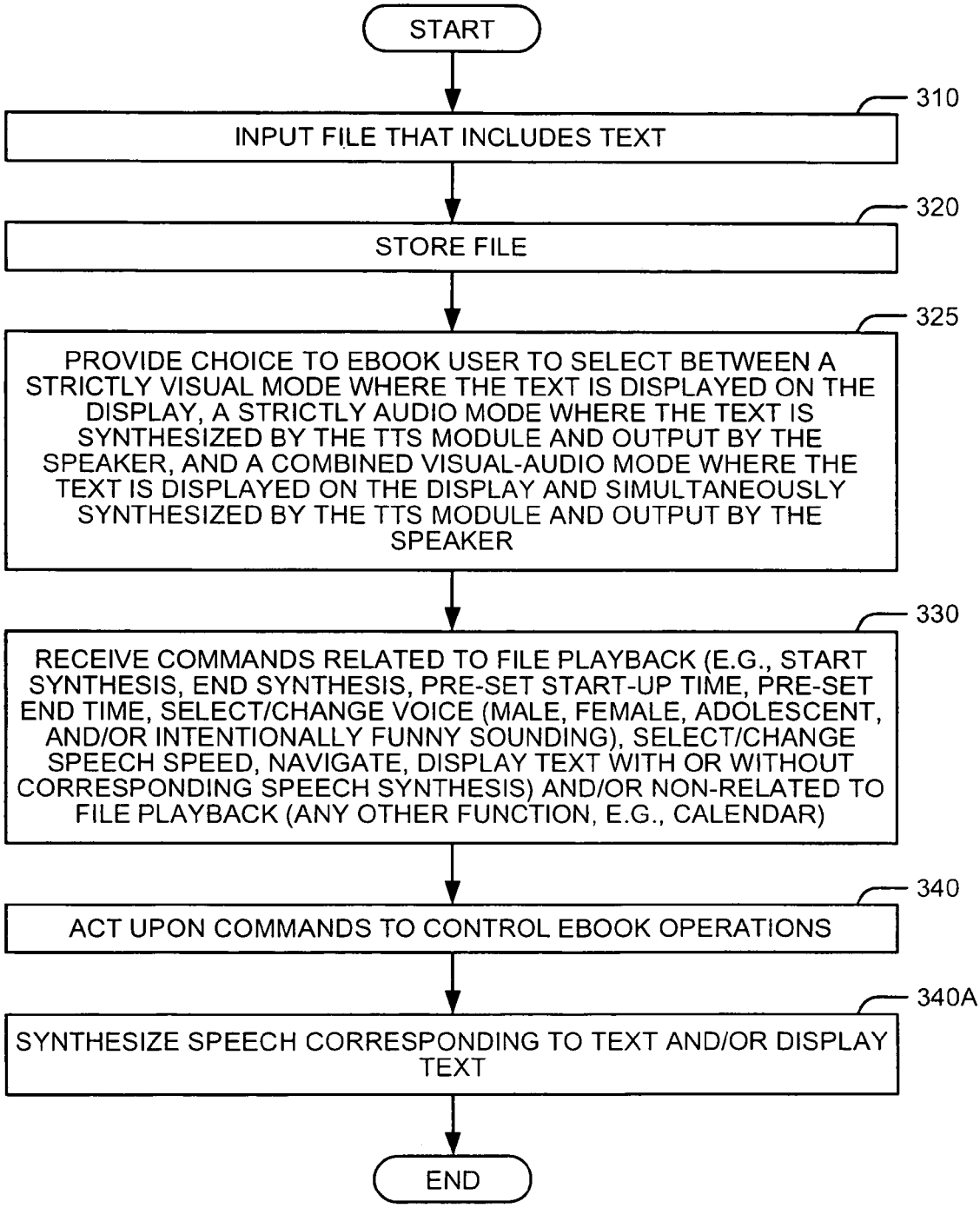
FIG. 3 is a flow diagram illustrating a method for using an Ebook having text-to-speech (TTS) capabilities, according to an illustrative embodiment of the present invention.

FIG. 3 is a flow diagram illustrating a method for using an Ebook having text-to-speech (TTS) capabilities, according to an illustrative embodiment of the present invention.

One or more files (hereinafter "file") is input into the Ebook (step 310). The file includes, at the least, text. The file may be provided via a memory device (e.g., floppy disk, compact disk, flash memory, and so forth), downloaded from the Internet, and so forth. The file may be an Ebook application file, an e-mail file, a Web page, a word processor document, and so forth. The file is then stored in the Ebook (step 320).

Optionally, at step 325, a choice is provided to a user of the Ebook to select between a strictly visual mode where the text is displayed on the display, a strictly audio mode where the text is synthesized by the TTS module and output by the speaker, and a combined visual-audio mode where the text is displayed on the display and simultaneously synthesized by the TTS module and output by the speaker (260, 270).

One or more commands are received by the Ebook (step 330). Preferably, the commands correspond to a playback of the file. The commands may include, for example: a command to begin synthesizing speech corresponding to the text included in the file so that the text is reproduced audibly; a command to end the synthesis; a command to preset a start-up time and/or an end time for the speech synthesis; a command to select/change a voice(s) used in the speech synthesis; a command to select/change the speed of the synthesized speech; a command corresponding to navigation through the file (e.g., to skip one or more pages, sections, chapters, and so forth); and so forth.

With respect to the selection of different voices, many different types of voices may be used in the synthesis of speech such as, for example, a man's voice, a woman's voice, an adolescent's voice, or even a funny sounding voice (e.g., chipmunk, etc.). Moreover, different voices may be used in a single playback of a single file. The selection of a particular voice may be made based on, for example, the preference of the user, the different application parameters/circumstances, and/or on a random basis.

Further, it is to be appreciated that some of the commands received at step 330 may not correspond to the playback of the text file. For example, if other functions are integrated with the Ebook such as, for example, a calendar function with a daily reminder schedule, then information relating to the calendar function (or any other function) may be received by the Ebook.

The commands are then acted upon to control operations of the Ebook having TTS capabilities (step 340). Step 340 may include the step of synthesizing speech corresponding to the text and/or displaying the text (step 340*a*). It is to be appreciated that step 340 may include acting upon any type of command received at step 330 including those in support of synthesizing the speech corresponding to the text and/or displaying the text, as well as other functions that may be integrated into the Ebook.

Figure 4:
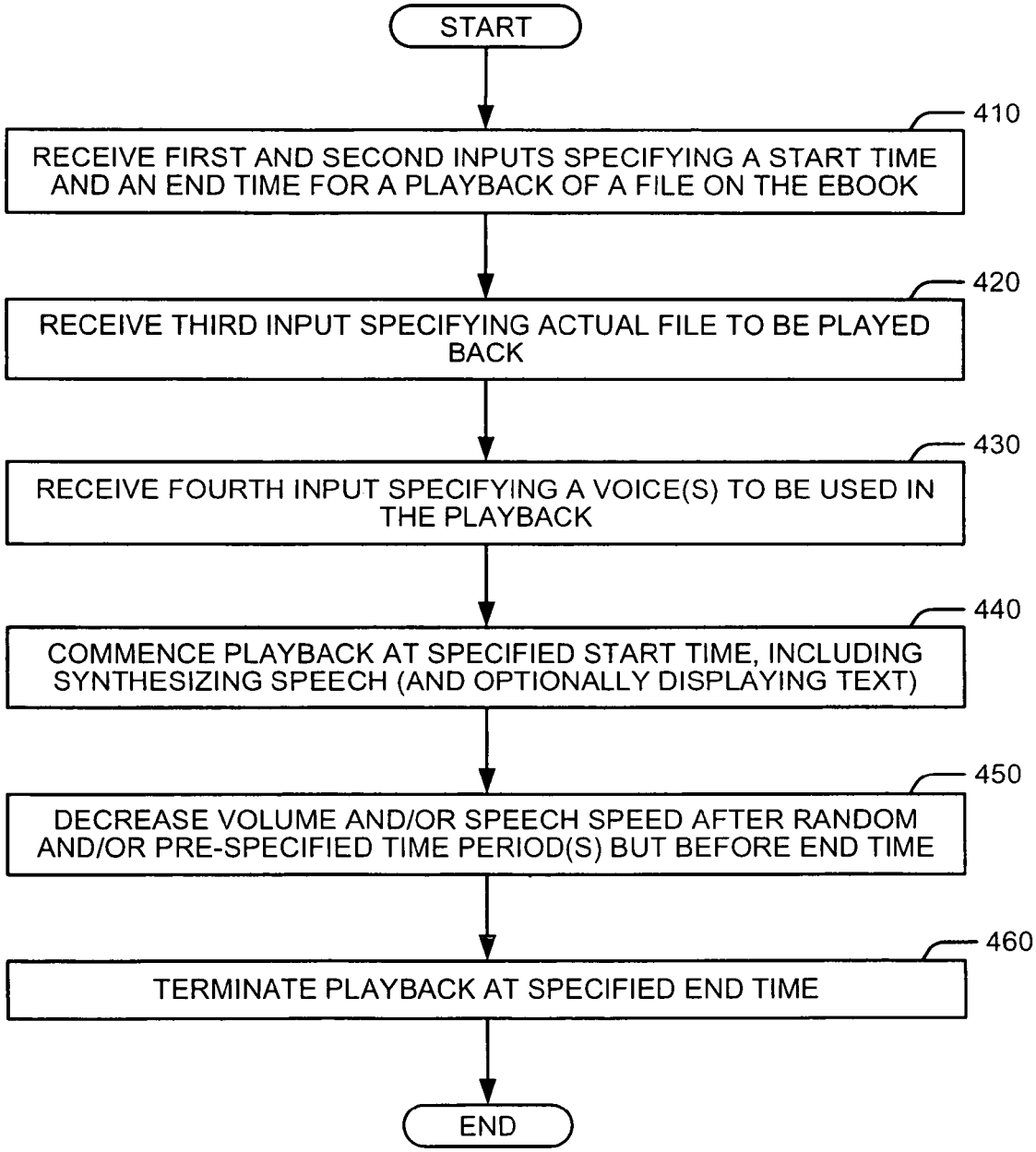
FIG. 4 is a flow diagram illustrating a method for using an Ebook as an audible storyteller, according to an illustrative embodiment of the present invention.

FIG. 4 is a flow diagram illustrating a method for using an Ebook as an audible storyteller, according to an illustrative embodiment of the present invention. Preferably, the method of FIG. 4 is used to reproduce a story to a child at about the child's bedtime. However, the method of FIG. 4 may be used for adults as well as children, and may be used at any time of day or night.

First and second inputs are received specifying a start time and an end time for a playback of a file on the Ebook (step 410). A third input is received specifying the actual file to be played back (step 420). A fourth input is received specifying a voice for the playback (step 430). It is to be appreciated that steps 420 and 430 may be performed randomly by the Ebook, upon simply receiving the first and second inputs. Alternatively, all (or some combination amounting to less than all) of the inputs may be user provided.

Playback is commenced at the selected start time, including synthesizing speech corresponding to the file so that the text file is audibly reproduced (step 440). Optionally, the text included in the file may be displayed concurrently with the outputting of the synthesized speech. After a random or a pre-specified time period has elapsed, but before the selected end time, the playback volume and/or the speech speed are/is decreased (step 450). Step 450 may be repeated a pre-specified or random number of times so as to gradually decrease the volume and/or speech speed in increments. The reduced playback volume and/or speech speed are intended to render a listener drowsy. The playback is terminated at the specified end time (step 460).

Figure 5:
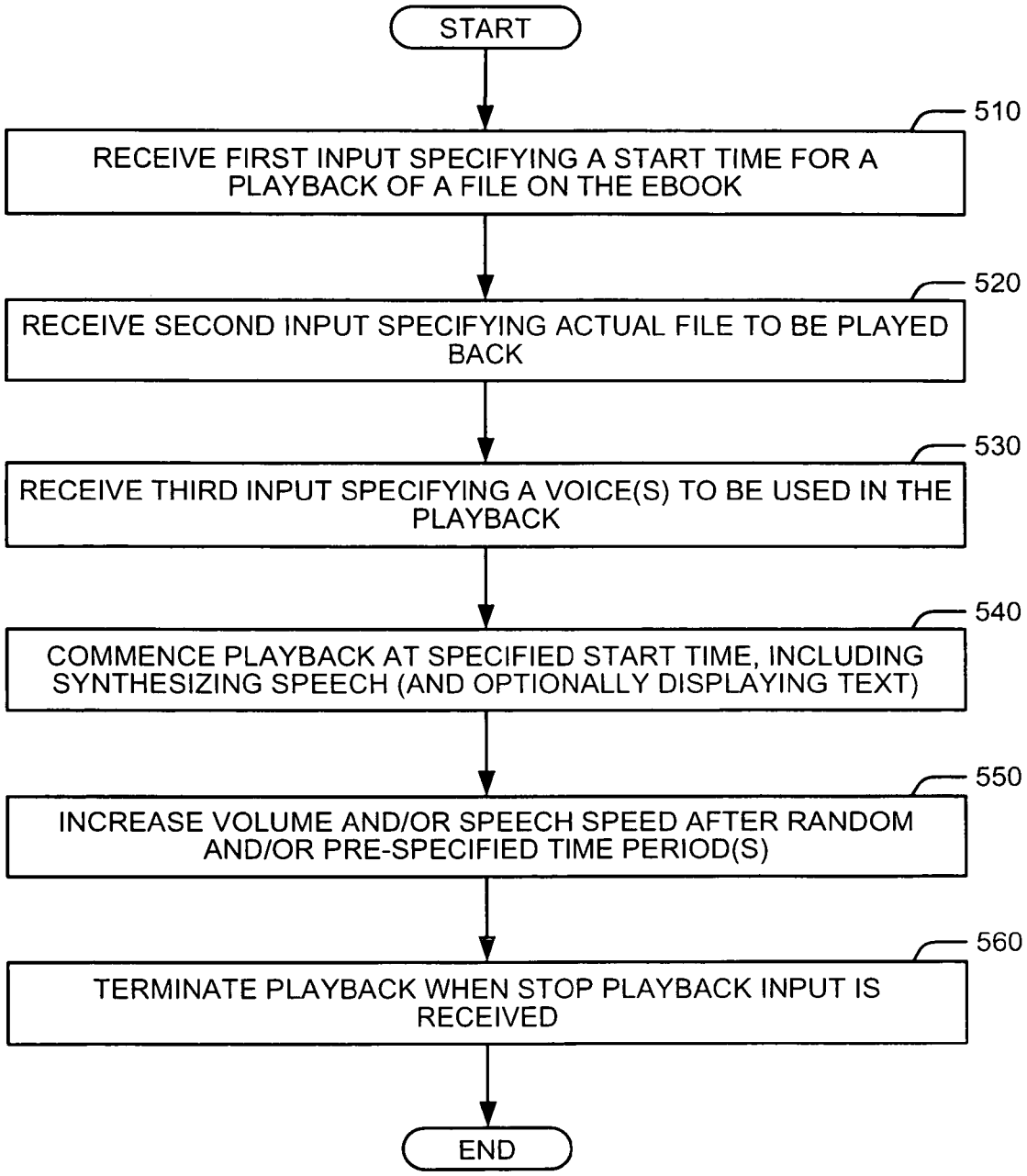
FIG. 5 is a flow diagram illustrating a method for using an Ebook as an wake-up alarm, according to an illustrative embodiment of the present invention.

FIG. 5 is a flow diagram illustrating a method for using an Ebook as an wake-up alarm, according to an illustrative embodiment of the present invention.

A first input is received specifying a start time for a playback of a file on the Ebook (step 510). A second input is received specifying the actual file to be played back (step 520). A third input is received specifying a voice for the playback (step 530). It is to be appreciated that steps 520 and 530 may be performed randomly by the Ebook, upon simply receiving the first input. Alternatively, all (or some combination amounting to less than all) of the inputs may be user provided.

Playback is commenced at the selected start time, including synthesizing speech corresponding to the text file so that the text file is audibly reproduced (step 540). Optionally, the text included in the file may be displayed concurrently with the outputting of the synthesized speech. After a random or a pre-specified time period(s) has elapsed, the playback volume and/or the speech speed are/is increased (step 550).

Step 550 may be repeated so as to incrementally increase the playback volume and/or the speech speed at predefined or random intervals until a stop playback input has been received. The playback is terminated when the stop playback input has been received (step 560).

Thus, the present invention advantageously allows the use of an Ebook with TTS for applications where reading is not convenient or desirable. For example, the present invention may be used to read while driving, for audibly reading stories to children, for a daily schedule reminder, and so forth. Given the teachings of the present invention provided herein, one of ordinary skill in the related art will contemplate these and various other scenarios in which the present invention may be advantageously employed while maintaining the spirit and scope of the present invention.

Although the illustrative embodiments have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

What is claimed is:

1. An Ebook, comprising:

a memory device for storing files, the files including text;

a text-to-speech (TTS) module for synthesizing speech corresponding to the text; and at least one speaker for outputting the speech, a processor, and wherein said Ebook is employed as a bedtime story teller such that said TTS module reduces over time a speed at which the speech is output from said TTS module.

2. The Ebook of claim 1, wherein said TTS module has a capability of switching between any one of a plurality of voices in synthesizing the speech, based on at least one of a random basis) user-specified selections, and parameters of a current one of the files.

3. The Ebook of claim 2, wherein the plurality of voices include at least one of a male voice, a female voice, an adolescent voice, and an intentionally funny sounding voice.

4. The Ebook of claim 1, wherein said TTS module lies a capability of synthesizing the speech in accordance with at least one of a pre-designated start time and a predesignated end time.

5. The Ebook of claim 1, wherein said Ebook commences operations as the bedtime reader based on a pre-designated start time or a receipt of a start input.

6. The Ebook of claim 1, wherein said Ebook terminates operations as the bedtime reader based on a pit-designated end time or a receipt of an end input.

7. The Ebook of claim 1, wherein said Ebook is employed as the bedtime story teller such that said processor reduces over time a volume of the speech output from the speaker.

8. A method for using an Ebook, comprising the steps of:

storing least one file in the Ebook, the at least one file including text;

synthesizing speech corresponding to the text; and outputting the speech, wherein said Ebook is employed as a wake-up alarm such that said synthesizing step synthesizes the speech at a pre-designated start time and said method further comprises the step of adjusting a volume of the speech to increase over an open-ended period of time until a stop input has been received, and wherein the method further comprises the step of adjusting the speed at which the speech is output, based on a random basis.

9. The method of claim 8, wherein the Ebook comprises a display and a speaker, and said method further comprises the steps of:

providing to a user of the Ebook a choice between a strictly visual mode where the text is displayed on the display, a strictly audio mode where the text is synthesized and output by the speaker, and a combined visual-audio mode where the text is displayed on the display and simultaneously synthesized and output by the speaker; and operating the Ebook in accordance with the choice of the user.

10. The method of claim 8, wherein said Ebook has a calendar function capability, and said synthesizing step synthesizes the speech to include information corresponding to a daily reminder schedule.

11. The method of claim 8, wherein the stop input comprises a contemporaneous stop input for effecting a contemporaneous termination of the outputting of the speech from the at least one speaker.

12. A method for using an Ebook, comprising the steps of:

storing at least one file in the Ebook, the at least one file including text;

synthesizing speech corresponding to the text; and outputting the speech, wherein said Ebook is employed as a bedtime story teller such that said synthesizing step reduces over time a speed at which the speech is output.

13. The method of claim 12, further comprising the step of switching between any one of a plurality of voices in synthesizing the speech, based on at least one of a random basis, user-specified selections, and parameters of a current one of the files.

14. The method of claim 13, wherein the plurality of voices include at least one of a male voice, a female voice, an adolescent voice, and an intentionally funny sounding voice.

15. The method of claim 12, wherein said synthesizing step is performed in accordance with at least one of a pre-designated start time and a pre-designated end time.

16. The method of claim 12, wherein said Ebook commences operations as the bedtime reader based on a pit-designated start time or a receipt of a start input.

17. The method of claim 12, wherein said Ebook terminates operations as the bedtime reader based on a pre-designated end time or a receipt of an end input.

18. The method of claim 12, wherein said Ebook is employed as the bedtime story teller such that said method further comprises the step of reducing over time a volume of the speech.

19. A hand-held device, comprising:

a memory device for storing files, the files including text;

a text-to-speech (TTS) module for synthesizing speech corresponding to the text; and at least one speaker for outputting the speech, a processor, and wherein said Ebook is employed as a bedtime story teller such that said TTS module reduces over time a speed at which the speech is output from said TTS module.

20. The hand-held device of claim 19, further comprising a display for displaying the text, and wherein a choice is provided to a user of the hand-held device to select between a strictly visual mode where the text is displayed on the display, a strictly audio mode where the text is synthesized by said TTS module and output by said speaker, and a combined visual-audio mode where the text is displayed on the display and simultaneously synthesized by said TTS module and output by said speaker.

21. The hand-held device of claim 19, wherein said TTS module has a capability of switching between any one of a plurality of voices in synthesizing the speech, based on at least one of a random basis, user-specified selections, and parameters of a current one of the files.

22. The hand-held device of claim 19, wherein said TTS module has a capability of adjusting a speed at which the speech is output there from, based on at least one of a random basis, user-specified selections, and parameters of a current one of the files.

23. The hand-held device of claim 19, wherein said hand-held device has a calendar function capability, and said TTS module synthesizes the speech to include information corresponding to a daily reminder schedule.

* * * * *